US005490735A

United States Patent [19]

Brandenburg et al.

[11] Patent Number: 5,490,735

[45] Date of Patent: Feb. 13, 1996

[54] METHOD OF OPERATING A PRINTER

[75] Inventors: Klaus Brandenburg, Freudenberg; Klaus-Peter Kluge, Siegen; Kurt-Hermann Richter, Freudenberg; Wendelin Weber, Siegen, all of Germany

[73] Assignee: PSI Printer Systems International GmbH, Siegen, Germany

[21] Appl. No.: 361,326

[22] Filed: Dec. 21, 1994

[30] Foreign Application Priority Data

Dec. 22, 1993 [DE] Germany ..... 43 43 977.7

[51] Int. Cl.[6] ..... B41J 11/52

[52] U.S. Cl. ..... 400/614; 400/607.2; 400/613.1

[58] Field of Search ..... 400/605, 607, 400/607.2, 607.3, 608.3, 608.4, 609, 611, 613, 613.1, 614, 616, 616.2, 619, 621

[56] References Cited

U.S. PATENT DOCUMENTS

| | | | |
|---|---|---|---|
| 4,823,694 | 4/1989 | Siegenthaler | 400/614 |
| 5,268,766 | 12/1993 | Nakadair et al. | 400/613 |
| 5,307,970 | 5/1994 | Shibnya et al. | 400/613.1 |
| 5,328,280 | 7/1994 | Ito | 400/607 |

*Primary Examiner*—Ren Yan
*Attorney, Agent, or Firm*—Herbert Dubno

[57] ABSTRACT

A method of operating a printer in which, after positioning of a paper web for printing and the printing of the web, the last printed sheet is removed and the leading edge of the web is retracted in a park position. The retraction of the leading edge of the web from this proper printing position until it passes a sensor is detected and this difference in displacement of the drive is stored for correction of advance of the same web from the parking position subsequently.

13 Claims, 2 Drawing Sheets

METHOD OF OPERATING A PRINTER

SPECIFICATION

1. Field of the Invention

Our present invention relates to a method of operating a printer and, more particularly, to a method of operating a printer in which two or more endless paper webs, e.g. a fanfold paper, or fanfolded form, is fed by respective in-feed heads (with appropriate positive-entrainment drives for the paper webs) along a printer path equipped with a printer head, and wherein the paper sheets can be separated from the webs.

2. Background of the Invention

Printers capable of feeding one or more continuous paper webs by an in-feed head along a printer path past a printing head are widely used to print on plain paper or on forms and, for rapid replacement of one form with another or one paper web with another, may be equipped with a second in-feed head into which the replacement form or web is fed. However, one of the problems with such systems is that each refeeding of a paper web or form requires readjustment of the print position on the latter. This can be a time-consuming and tiresome operation.

OBJECTS OF THE INVENTION

It is the principal object of the present invention to provide an improved method of operating a printer whereby the paper can be positioned rapidly and automatically to an exact printing position after a removal of a particular web from the printing path.

It is also an object of the invention to provide a printer having a cutting device or other system for separating paper sheets from the web which can also allow exact positioning of the paper web, whether it is for printing or for cutting, without the need for repeated trial operations.

Still another object of the invention is to provide an improved method of operating a printer whereby drawbacks of earlier systems are avoided.

SUMMARY OF THE INVENTION

These objects and others which will become apparent hereinafter are attained, in a method of operating a printer in which endless paper webs or forms are fed by means of drivable in-feed heads via respective feed paths onto a printer path extending past the printing head and preferably can be subdivided into sheets downstream of the printer head.

According to the invention, upon replacement of the paper source and/or the forms which are fed to the printer, after separation of the last paper sheet from the web, the leading edge of the paper web thus formed is retracted to a sensor. Upon detection by the sensor of this leading edge or triggering of the sensor, the difference from the set point movement of the drive and the actual value of the latter is formed and stored, e.g. in a memory (which can be part of the central controller of the machine or on a drive cassette replaceable on the machine). The paper web is then retracted further into a predetermined part position. For further operation of the printer with this web, the leading edge is advanced from the park with the set point value for each advance being corrected by the difference stored for this paper web.

According to the invention, upon insertion of the paper web in an in-feed head, the stored difference for the in-feed head is canceled and as the edge of the new web passes the sensor, synchronization of the further transport steps is initiated. This includes the eventual storage of a new difference value.

The sensor is preferably so designed that it initiates storage, triggers synchronization and in general is effective at a portion of one of the flanks only of a signal of the sensor.

According to a feature of the invention, the aforementioned portion of one of the two flanks of the sensor is effective in only one direction of movement of the web. For example, upon in-feed of the paper web, the sensor may be effective on a forward movement or advance thereof but is unaffected by the leading edge in a retraction thereof and the difference as a newly inserted paper web is first formed and stored during a subsequent advance, whereupon the paper web is ultimately retracted until its leading edge lies in the park position.

As will be apparent, various other modes of operation are permissible to eliminate hysteresis effects between the advance and retract movements of the paper web. The invention, more particularly, can comprise the steps of:

(a) displacing a first paper web from one of the stores with a first of the in-feed heads along the path and past the head to print successive sheets of the first paper web with a given positioning of an imprint relative to a leading edge of the respective sheets;

(b) for changeover of the stores to print sheets of a second of the paper webs, separating a last-printed sheet from the first paper web to produce a leading edge of the first paper web at a setpoint position along the path corresponding to the given positioning of the imprint;

(c) retracting the leading edge of the first paper web from the setpoint position until the leading edge of the web reaches a sensor upstream of the printer head with the first in-feed head and storing by activation of the sensor a displacement difference of the first in-feed head between the setpoint position of the leading edge of the first paper web and a position of the leading edge of the first paper web at the sensor;

(d) thereafter withdrawing the leading edge of the first paper web further to a predetermined parking position; and (e) for further printing of the first paper web, advancing the first paper web with the first in-feed head by a sheet-feed magnitude for each sheet thereof corrected by the stored displacement difference for the first in-feed head.

Advantageously, upon insertion of a further paper web in a respective one of the in-feed heads, any previous displacement difference stored for the one of the in-feed heads is automatically cancelled and further paper-web transport is synchronized upon passage of a leading edge of the further paper web past the sensor.

The sensor can produce a signal having flanks and is responsive with a predetermined part of one of the flanks so that upon feeding of a paper web along the path the sensor is rendered effective upon detection thereby of a leading edge of the fed web, the sensor being unresponsive to a retraction of a cut edge of a paper web and the difference is formed only upon an advance of a cut edge following a retraction, with subsequent displacement of the cut edge into the parking position.

The sensor, upon advance of a paper web from a respective parking position along the path upon passage of a respective leading edge, reverses the respective in-feed head and, in a return movement of the web, stores the position of the respective in-feed head upon passage by the respective leading edge of the sensor, and in a new advance to a printing position, a transport path is increased by a difference stored upon the last return movement, while upon retraction of a partially printed web into its park position after separation of a printed a sheet therefrom, establishes a difference which is stored for at least a newly fed web to be printed.

Upon insertion of an inserted paper web into one of the in-feed heads, a leading edge of the inserted web can be disposed upstream of a respective park position of the respective head, and wherein between the leading edge of the inserted web and the respective park position another sensor is disposed which is actuated upon advance of the leading edge of the inserted web and extinguishes for this inserted web any previously stored difference for the respective head and renders the first-mentioned sensor effective to store a new difference.

This also applied where the inserted paper web is in a cassette having a mark at which a leading edge of the inserted web is disposed upstream of the park position, the cassette being provided with the in-feed head and being insertable into and replaceable in the printer.

Also according to the invention, upon insertion of a paper web into one of the in-feed heads, a transport path length is determined between the respective park position and the sensor, and upon advance of the leading edge of the inserted web by a distance greater than the length, any previously stored difference is canceled for the respective in-feed head and the sensor is rendered effective to store a new difference.

The cassettes can be associated with storage places regarding the differences for the heads of the cassettes and can have markings which are automatically sensed to determine a storage location for a stored difference associated with a respective cassette.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
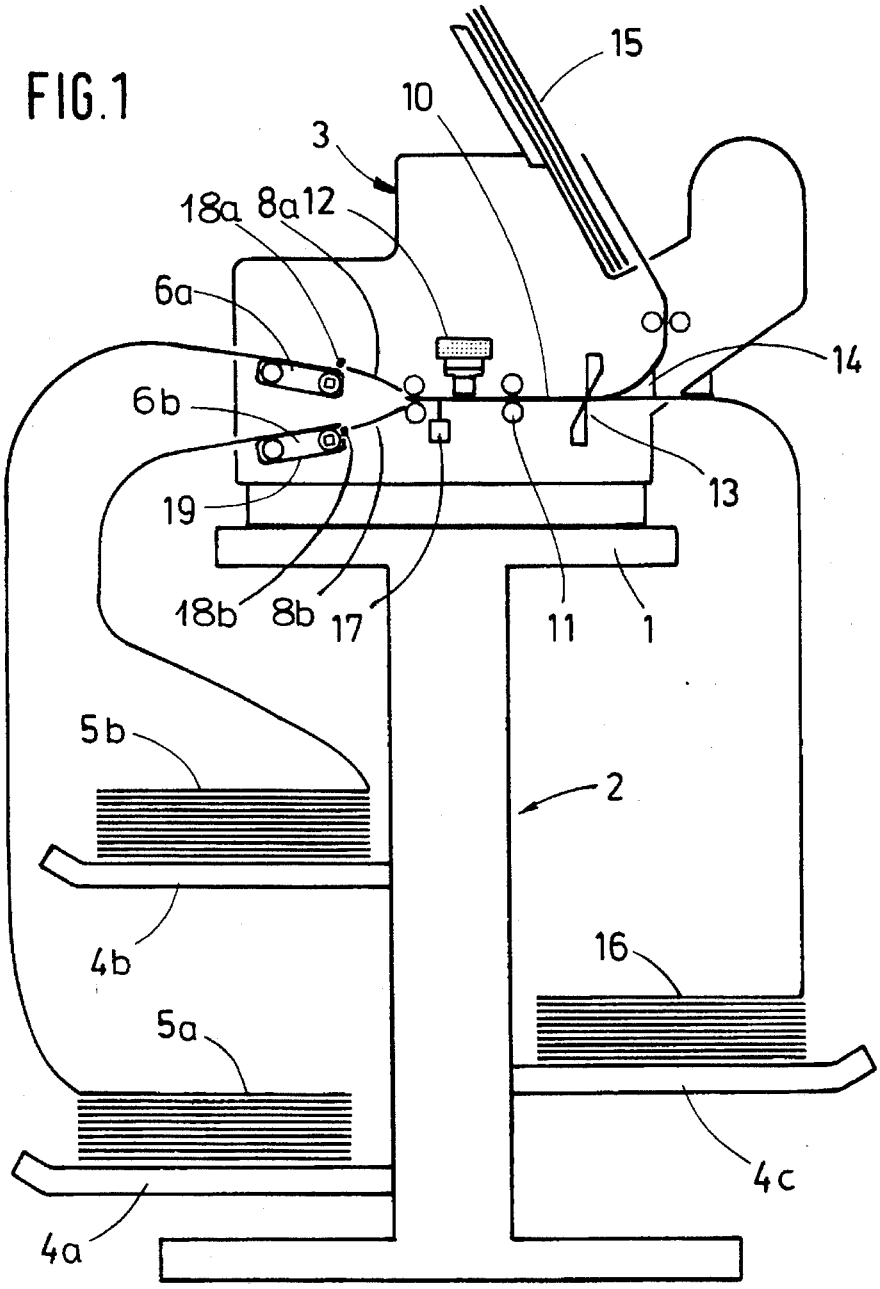
FIG. 1 is a schematic vertical section through a printer provided on a table according to the invention.

As can be seen from FIG. 1, a plate 1 of a table 2 carries a printer 3 which has been shown diagrammatically. From the leg of table 2, platforms 4*a*, 4*b* and 4*c* project and receive fanfold paper stacks 5*a* and 5*b*, as well as the printed fanfold paper stack 16.

The perforated margins of the paper webs from the stacks 5*a* and 5*b* are engaged in pin belts 19 of a pair of in-feed heads 6*a* and 6*b* shown to have leading edges of the paper webs disposed at parking positions shortly upstream of the inlet paths 8*a* and 8*b*, respectively.

The inlet paths 8*a* and 8*b* form prongs of a fork leading to a printer path 10 extending past a printer head 12.

More particularly, the printer path 10 is provided with bars on transport rollers 11 upstream and downstream of the printer head 12 and feed the paper web to a cutting device 13 along the path 10. From the cutting device, the paper web can pass through the branching deflector 14 to be collected as the stack 16 or can be deflected upwardly selectively to be deposited in a stack of sheets represented at 15.

The printer path 10 is equipped with a sensor 17 for detecting the leading edge of the endless paper webs. Substantially in the region of each parking position and just upstream thereof, sensors or feelers 18*a* and 18*b* are provided to detect the presence of paper at the parking position.

Newly inserted paper is so introduced into the pin belts of the respective in-feed heads 6*a* and 6*b* that their leading edges lie in insertion positions upstream of the respective parking positions and, therefore, upstream of the respective feelers 18*a* and 18*b* so that the latter do not yet detect the paper webs.

To feed the paper web, one of the in-feed heads 6*a*, 6*b* is driven and for that purpose can have an appropriate drive represented by a motor 6*a*' or 6*b*' (FIG. 4) controlled by a microprocessor circuit 20 having a start input represented at 21.

The processor 20 may have a select input 22 enabling selection of the paper web to be fed for the desired printed forms and, therefore, enabling selection of the respective in-feed head 6*a* or 6*b*.

The leading edge of the selected paper web is advanced by the respective head 6*a*, 6*b* until it passes the respective feed path 98*a* or 9*a* and is in the region of the sensor 17. The sensor 17 can detect the arrival of the leading edge of the selected paper web and can drive the appropriate motor 6*a*' or 6*b*' via the controller 20 to carry the paper web into the region of the printing head 12. By appropriate test prints, the position of the paper web can be corrected for proper printing and the repetition of the imprint on successive sheets can be effected synchronously and with exact print alignment. The processor 20, therefore, advances each sheet to the same selected correct position and each sheet can be cut off as printed by the cutter 13.

Figure 4:
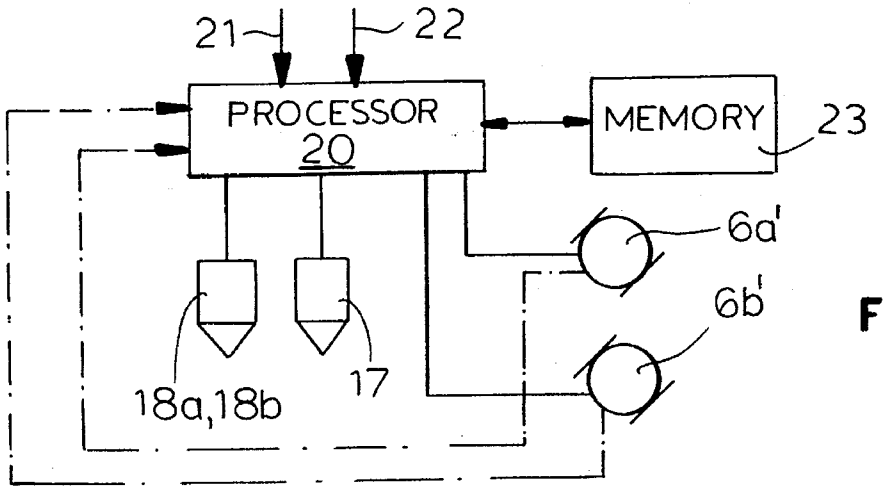
FIG. 4 is a block diagram of a simplified circuit for controlling certain aspects of the printer operation relevant to the invention.

Should printing of different forms be desired, after the last printed sheet has been cut off or removed past the printer head 12, the web is retracted by the length remaining on the path 10. In this case, the position in which the sensor 17 is uncovered by the paper is determined and the difference between the actual value of the position of the paper drive and its set point is formed and stored in the memory 23 (FIG. 4).

More particularly, in the appropriate location in the storage 23, i.e. at an address associated with the selected in-feed head and drive, a difference is stored representing the difference in the drive positions between the correct formation position for that web and the position in which the leading edge crosses the sensor 17 during retraction. The paper is then further retracted into its park position and the other paper web can be advanced in the manner described, printed and parked by a corresponding sequence of operations.

If the same paper web is to be later printed again, the respective feeler 18*a*, 18*b* signals to the processor 20 that the web is not a new insertion but rather a web whose sheet have been printed upon earlier and for which a difference has been stored previously.

Figure 2:
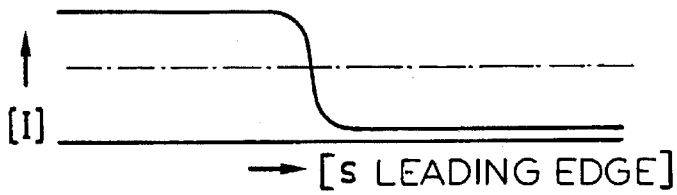
FIG. 2 is a graph plotting current along the ordinate versus time along the abscissa showing the flank of the response curve of the sensor which is used according to the invention.

Accordingly, its leading edge is advanced onto the path 10 and after passing the sensor 17 is reversed before the correction is added to its advance, thereby ensuring that the sensor 17, for advance of the web anew will sense the latter in the same direction that the web was sensed in generating the difference in the first place. The difference generation and the correction of the feed of the web, therefore, can be accomplished without hisoresis errors. Correspondingly, the measurement after leaving the sensor can be effected with a brief advance followed by retraction to eliminate hysteresis errors. To maximize sensitivity of the sensor 17, as shown in FIG. 2, its response is determined at a steep flank of its current signal and to avoid hysteresis errors, this response is always generated during either a paper advance or a paper retraction. Upon retraction, the measurement process always is carried out with a preceding advance and then withdrawal into the parking position.

While photosensitive sensors and feelers are preferably used in accordance with the invention, mechanical sensors or the like can be employed to respond to the position of the leading edge of the paper web.

It has been found that more than two in-feed heads can be utilized with more than two different paper heads or forms which must be switched rapidly between one another. A stack can be held in readiness with a further in-feed head so that, upon completion of one stack, the stack in readiness can be fed. At most three in-feed heads should be provided, however.

Figure 3:
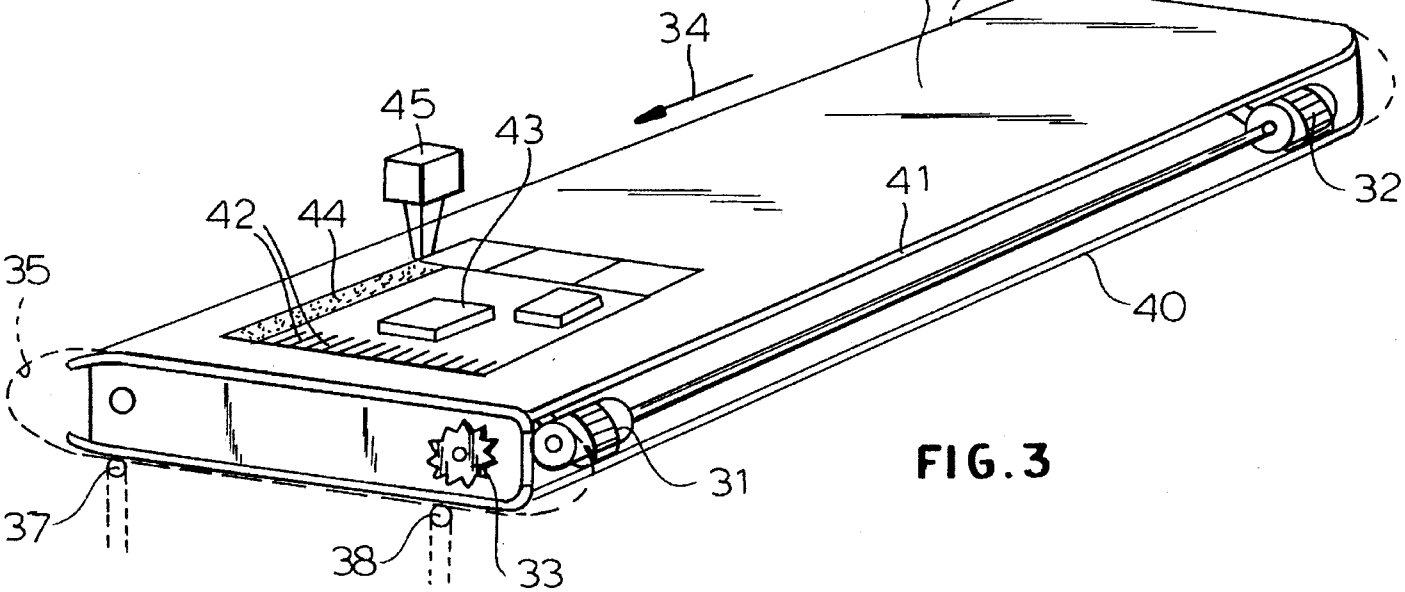
FIG. 3 is a diagrammatic perspective view illustrating a cassette which can be used in accordance with the invention.

According to the invention, the in-feed heads may be provided in cassettes 30 (FIG. 3) in which the pin belts 31 and 32 are here provided with a star wheel 33 which can engage a driving star wheel when the cassette is inserted, in the direction indicated by the arrow 34 through slots 35 and 36 in walls of the printer.

The holders can be overlapping edges of the printer housing and catch levers, spring-loaded pins or the like can be provided as shown at 37 and 38 to releasably retain the cassette in place. The cassette can have cover plates 39 and 40, the edge 41 of one of these plates, composed of sheet metal, forming the marking at which the leading edge of a respective paper web can be positioned, upstream of the respective feeler 18*a*, 18*b* as desired.

Upon insertion of the cassette into the printer, the cassette can have contacts 42 of its internal circuitry which can cooperate with the control circuitry of FIG. 4 and in their circuitry of the printer. The cassette can have a memory 43 for storing a respective difference and can have markings, such as a bar code or magnetic strip 44 sensed by a reading head 45 for determining the memory address or location associated with the difference assigned to that head, the reader 45 being provided in the printer.

Thus, if corresponding storage locations are provided for storing the respective differences at respective addresses, the storage address can be automatically read or manually read from visual data or displayed data. The automatic reader 45 can automatically select the proper storage address.

The invention allows a variety of variations. For example, feelers 18*a* and 18*b* can be eliminated when the advance of the paper to the sensor 17 is determined and this distance is used in part for the switching operation. It can thus be easily determined whether the leading edge of a paper web is advanced from the parking position or from an initial feed position upstream of the parking position. Upon an advance below a predetermined value from the parking position to the sensor, the stored difference is read out and supplied as a correction value to the drive. When the feed exceeds this value, indicating a new web, the previously stored difference for the particular head can be canceled and a new difference stored. The holders for the in-feed cassettes can be varied as well as long as they define a positive seat for the cassette and ensure a positive connection for the drive unit.

We claim:

1. A method of operating a printer having respective stores for a plurality of paper webs to be printed, at least one printer head disposed along a printing path, respective driven in-feed heads between said stores and said path for feeding the respective webs selectively to and along said path and past said printer head, and means downstream of said path for leading said webs away from said path, said method comprising the steps of:

(a) displacing a first paper web from one of said stores with a first of said in-feed heads along said path and past said head to print successive sheets of said first paper web with a given positioning of an imprint relative to a leading edge of the respective sheets;

(b) for changeover of said stores to print sheets of a second of said paper webs, separating a last-printed sheet from said first paper web to produce a leading edge of said first paper web at a setpoint position along said path corresponding to said given positioning of said imprint;

(c) retracting said leading edge of said first paper web from said setpoint position until said leading edge of said web reaches a sensor upstream of said printer head with said first in-feed head and storing in memory by activation of said sensor a displacement difference of said first in-feed head between said setpoint position of said leading edge of said first paper web and a position of said leading edge of said first paper web at said sensor;

(d) thereafter withdrawing said leading edge of said first paper web further to a predetermined parking position; and (e) for further printing of said first paper web, advancing said first paper web with said first in-feed head to a desired print position for each sheet thereof corrected based upon the stored displacement difference for said first in-feed head.

2. The method defined in claim 1, further comprising the steps of, upon insertion of a further paper web in a respective one of said in-feed heads, automatically cancelling any previous displacement difference stored for said one of said in-feed heads and synchronizing further paper-web transport upon passage of a leading edge of said further paper web past said sensor.

3. The method defined in claim 1 wherein said sensor produces a signal having flanks, said method comprising storing said difference in memory in response to a predetermined part of one of said flanks.

4. The method defined in claim 1 wherein said sensor produces a signal having flanks and is responsive with a predetermined part of one of said flanks said method comprising upon feeding of a paper web along said path, rendering effective said sensor upon detection thereby of a leading edge of the fed web, said sensor being unresponsive to a retraction of a cut edge of a paper web and said difference is formed only upon an advance of a cut edge following a retraction, with subsequent displacement of said cut edge into said parking position.

5. The method defined in claim 1 wherein the sensor, upon advance of a paper web from a respective parking position along said path upon passage of a respective leading edge, reverses the respective in-feed head and, in a return movement of the web, stores the position of the respective in-feed head upon passage by the respective leading edge of the sensor, and in a new advance to a printing position, a transport path is increased by a difference stored upon the last return movement, while upon retraction of a partially printed web into its park position after separation of a printed a sheet therefrom, establishes a difference which is stored for at least a newly fed web to be printed.

6. The method defined in claim 1 wherein upon insertion of an inserted paper web into one of said in-feed heads said method disposes a leading edge of the inserted web upstream of a respective park position of the respective head, and wherein between the leading edge of the inserted web and the respective park position another sensor is disposed which is actuated upon advance of the leading edge of the inserted web and extinguishes for this inserted web any previously stored difference for the respective head and renders the first-mentioned sensor effective to store a new difference.

7. The method defined in claim 1 wherein upon insertion of an inserted paper web into one of said in-feed heads in the form of a cassette having a mark at which a leading edge of the inserted web is disposed upstream of a respective park position of the respective head, the leading edge of the web is positioned at said mark, and between the leading edge of the inserted web and the respective park position another sensor is disposed which is actuated upon advance of the leading edge of the inserted web and extinguishes for this inserted web any previously stored difference for the respective head and renders the first-mentioned sensor effective to store a new difference.

8. The method defined in claim 1 wherein upon insertion of an inserted paper web into one of said in-feed heads, a leading edge of the inserted web is disposed upstream of a respective park position of the respective head, a transport path length is determined between the respective park position and the sensor, and upon advance of the leading edge of the inserted web by a distance greater than said length, any previously stored difference is canceled for the respective in-feed head and said sensor is rendered effective to store a new difference.

9. The method defined in claim 1 wherein upon insertion of an inserted paper web into one of said in-feed heads in the form of a cassette having a mark at which a leading edge of the inserted web is disposed upstream of a respective park position of the respective head, the leading edge of the web is positioned at said mark, a transport path length is determined between the respective park position and the sensor, and upon advance of the leading edge of the inserted web by a distance greater than said length, any previously stored difference is canceled for the respective in-feed head and said sensor is rendered effective to store a new difference.

10. The method defined in claim 1 wherein at least two of said in-feed heads are provided, each along a respective in-feed path upstream of said printing path.

11. The method defined in claim 1 wherein each in-feed head forms part of a removable cassette replaceable in the printer, further comprising the steps of removing one of said cassettes and replacing the removed cassette by another cassette.

12. The method defined in claim 11 wherein said method associates said cassettes with storage places recording said differences for the heads of said cassettes.

13. The method defined in claim 11 wherein said cassettes have sensible markings, said method comprising reading said markings upon insertion of the respective cassettes in said printer determining a storage location for a stored difference associated with a respective cassette.

* * * * *